United States Patent [19]

Turner

[11] Patent Number: 4,556,201

[45] Date of Patent: Dec. 3, 1985

[54] HANDRAIL FOR TODDLERS

[76] Inventor: Robert M. Turner, 440 McMurchy Ave. South, Apt. #203, Brampton, Ontario, Canada, L6Y 2N5

[21] Appl. No.: 661,429

[30] Foreign Application Priority Data

Jun. 1, 1984 [CA] Canada ..... 455.671

[22] Filed: Oct. 16, 1984

[51] Int. Cl.[4] ..... E04H 17/14

[52] U.S. Cl. ..... 256/59; 248/251; 52/173 R

[58] Field of Search ..... 248/251; 256/65, 59

[56] References Cited

U.S. PATENT DOCUMENTS 1,785,487 12/1930 McAvoy ..... 256/72 X
3,005,242 10/1961 Roberts ..... 256/59 X
3,804,374 4/1974 Thom ..... 256/59

*Primary Examiner*—Andrew V. Kundrat
*Attorney, Agent, or Firm*—Krass & Young

[57] ABSTRACT

A handrail assembly for the erection or a temporary handrail designed for a toddler or young child including a set of elongate rail members which can be connected end-to-end to provide a handrail member of the desired length. Two or more elongate hanging devices are used to mount the handrail member below another handrail. Each of these devices is capable of being mounted at one end thereof to a wall at a location which is a mounting point for the other handrail. Preferably each hanging device has a support bracket attached to its bottom end, which bracket is connectable to the handrail.

20 Claims, 7 Drawing Figures

HANDRAIL FOR TODDLERS

BACKGROUND OF THE INVENTION

This invention relates to handrail assemblies and particularly an assembly designed to provide a temporary handrail for toddlers or small children.

A variety of handrail constructions are known at the present time, some being designed for installation on a wall along a stairway while others are designed for mounting on posts. Generally the handrails are mounted at a height above the stairs or the floor suitable for an average adult. Although the provision of two or more rails at different heights appears to be known, such rails appear to have been provided in the past mostly along elevated locations such as a porch or sundeck with the lower rails being intended to prevent people from falling off the porch or sundeck by passing under the uppermost rail.

One area of concern for a family with young children is the possibility of a yound child falling down the stairs in a house. For a small child or toddler, the existing handrail is generally mounted too high above the stairs for the child to reach or use. In the past, this problem has been partially met by providing temporary gates that close off the stairway at at least one end so that the child will not attempt to climb or descend the stairs without the assistance of an adult. However the known gates for closing off the end of a stairway suffer from several disadvantages including the fact that they are annoying for adults who must open or remove the gate each time they wish to use the stairway. Secondly the child is not provided with means for negotiating the stairs himself and it would be advantageous if the child could safely negotiate the stairways without the assistance of an adult or older child.

Canadian patent number 619,682 issued May 9, 1961 to Louis Blum describes an ornamental rail structure for mounting on special posts. There are upper and lower rails secured to the posts by expansible clamping members. The clamps are mounted by bolts in vertical slots formed in the posts. The posts which can be made of aluminum, can be covered on one side by wooden facing strips having a T-shaped cross-section. This known construction is not suitable for mounting handrails along an existing inner wall of standard construction inside a house or dwelling.

More recent U.S. Pat. No. 3,804,374 issued Apr. 16, 1974 to Architectural Art Mfg., Inc. describes a handrail structure that is also designed for mounting on special posts. An upper handrail can be mounted along the top of the posts while a lower handrail is provided approximately midway up the posts. The two handrails are mounted in a similar manner and the mounting mechanism includes a T-shaped bracket connected to a transversely extending tube. Clamp mechanisms and a bolt secure the inner end of the tube to the post. Again the handrails taught in this patent specification are not suitable for mounting on a standard inside wall such as one constructed from wooden studs and wallboard.

It is an object of the present invention to provide a handrail assembly which can be quickly and easily mounted to a wall extending along a stairway for the purpose of providing a temporary handrail for small children.

It is a further object of the invention to provide a child's handrail that requires no new holes to be put in a wall (assuming that there is already an existing handrail mounted on the walls for adults) and that requires no special skills or tools in order to be erected. When the handrail assembly of the present invention is no longer required because the small child has grown sufficiently so that he or she is able to use the adult handrail, the temporary handrail can be removed from the wall and dismantled without damaging the wall or leaving hard to remove marks on the wall.

SUMMARY OF THE INVENTION

According to one aspect of the present invention, a handrail assembly comprises a handrail member, support brackets connectable to the handrail member at one end for supporting the handrail member at a short uniform distance from an adjacent wall, and at least two elongate hanging devices for mounting the handrail member below another handrail. These devices are adapted to be mounted at one end to the adjacent wall at the same location as the other handrail. Each is connectable at the other end to one of the support brackets. Means are provided for connecting the other end of each hanging device to one of the support brackets.

Preferably the hanging devices are flat at least at the one ends thereof adapted to be mounted to the adjacent wall and the devices have screw or bolt holes formed at these one ends.

According to another aspect of the present invention, a handrail assembly comprises a set of elongate rail members having means for connecting the rail members together in end-to-end fashion to form a handrail member of desired length. At least two elongate hanging devices are also provided for mounting the handrail member below another handrail. Each of these devices is capable of being mounted at one end thereof to a wall at a location which is a mounting point for the other handrail. Support brackets are connected to the handrail member for supporting the handrail member on the hanging devices so that the handrail is disposed a short uniform distance from the wall. Means are provided for mounting each of the support brackets on the other end of a respective one of the hanging devices.

Further features and advantages will become apparent from the following detailed description, when taken in conjunction with the accompanying drawings.

DETAILED DESCRIPTION OF PREFERRED EMBODIMENT

Figure 1:
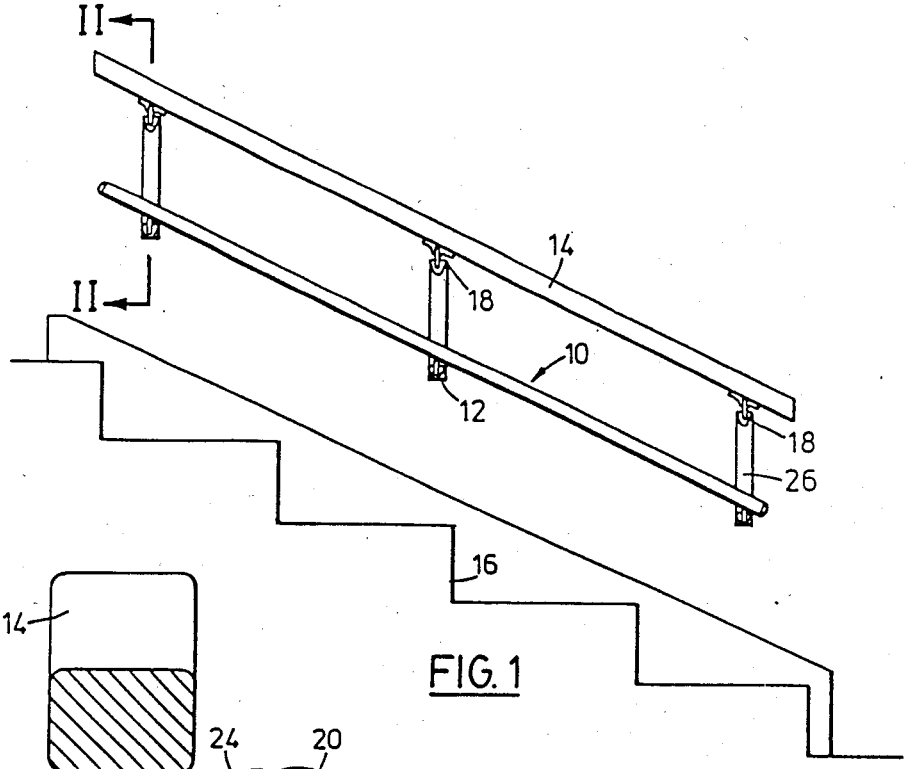
FIG. 1 is a side elevation showing a handrail constructed in accordance with the present invention mounted to a wall below a standard handrail.
Figure 2:
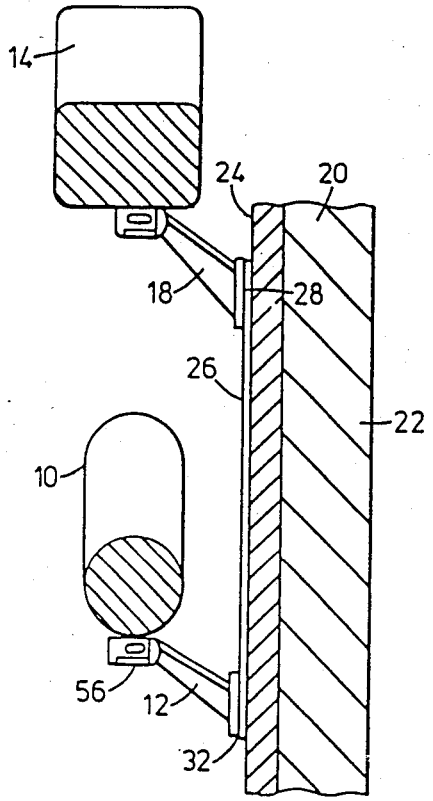
FIG. 2 is a cross-sectional elevation taken along the line II—II of FIG. 1.

A handrail assembly constructed in accordance with the present invention is shown in FIGS. 1 and 2 and includes a handrail member 10 mounted on support brackets 12 which can be of standard construction. The handrail assembly of the present invention is designed to be mounted below and in conjunction with an existing handrail 14 which can be of standard construction. The handrail 14 is mounted to the wall at a height above the stairs 16 suitable for normal adults. However the existing handrail 14 is too high for a small child or toddler to use and therefore the stairs could present a safety hazard for a small child who attempts to negotiate them in the absence of a lower handrail member such as the member 10 shown. In a typical installation, the handrail member 10 for the small child is mounted 12 to 16 inches below the adult handrail 14. In the illustrated embodiment the handrail 14 is mounted on three support brackets 18 but it will be appreciated that as few as two support brackets and more than three support brackets are used for some handrails. Generally speaking the support bracket 18 is mounted to the wall 20 by means of suitable screws (not shown). Preferably the bracket 18 is mounted to the wall in the region of a wooden wall stud 22 in order that sufficient support for the bracket will be provided by the wall. Typically the wooden wall studs are covered by a layer of wall board 24.

Figure 3:
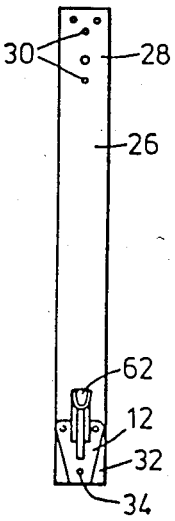
FIG. 3 is a detail view in elevation of a hanging device having a support bracket for a handrail member attached to its bottom end.
Figure 4:
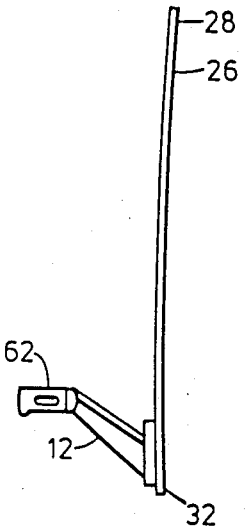
FIG. 4 is a rightside view of the hanging device and support bracket shown in FIG. 3.

The handrail assembly of the present invention includes at least two elongate hanging devices 26 which are used to mount the handrail member 10 below the existing handrail 14. Each device 26 is designed to be mounted at one end 28 to the adjacent wall at the same location as one support bracket 18 for the handrail 14. For this purpose the end 28 is flat and has screw or bolt holes 30 formed therein. Preferably there are a number of holes 30 provided so that the holes fit the screw hole patterns of two or more different types of handrail support brackets. For example the five holes illustrated in FIG. 3 enable the hanging device to be used with at least three different types of standard handrail support brackets now in use. Each of the hanging devices 26 is connectable at its other end 32 to one of the support brackets 12. Preferably the means 34 for connecting the end 32 to the support bracket are such that they do not protrude from the rear surface of the hanging device 26. This enables the hanging device 26 to lie flat against the wall board 24 as shown in FIG. 2. Furthermore if the connecting means do not protrude from the rear of the device 26, the wall board 24 will not be damaged or marred in the region of the bottom end 32. In the preferred embodiment of the handrail assembly, the support bracket 12 is permanently riveted to the end 32 of the hanging device. An alternative means for connecting the basket 12 would be the use of three set screws threaded into small holes drilled into the bottom end of the hanging device. A preferred form of hanging device is made from flat steel plate and is 14 inches long (35 centimeters) and 1 and $\frac{3}{8}$ inches wide (3.5 centimeters). The thickness of the plate is approximately $\frac{1}{8}$ inch. Preferably the hanging device has a slight arc or curves extending from the end 32 to the end 28 of the device. This arc is in a plane perpendicular to the flat metal plate forming the device. It will be appreciated that when the hanging device is mounted against a flat wall in the manner shown in FIG. 2, the device straightens and this creates a spring load pushing the bottom end 32 of the device against the wall. This helps to prevent the handrail 10 from being pulled away from the wall, which event might result in minor damage to the wallboard when the handrail end is released.

It will be appreciated that in order to mount the hanging devices 26, the existing handrail 14 and its support brackets 18 must be removed from the wall. This is a simple operation and involves removing the screws that attach the brackets 18 to the wall. When this operation has been carried out, the hanging devices 26 can then be attached to the wall at their ends 28. At the same time the handrail 14 is reattached to the wall. Preferably new, longer screws which are provided with the present handrail assembly are used for this purpose. These screws, which can be standard wood screws of sufficient length, extend through both the holes provided in the support brackets 18 and through the holes 30 which align with the holes in the brackets 18. Because these screws are longer than the previously used screws, they will extend further into the wood of the stud 22 and thus provide a secure means for fastening both the hanging device and bracket 18.

Figure 5:
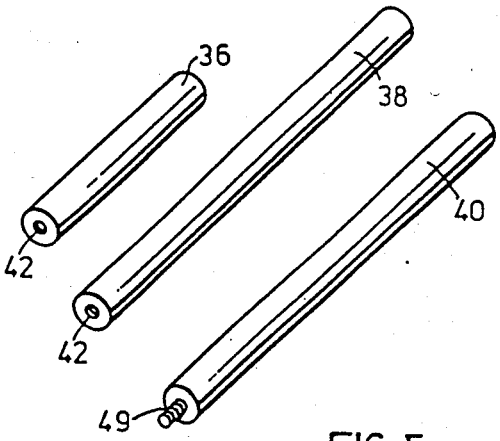
FIG. 5 is a perspective view of several different rail members that can form part of the handrail assembly.
Figure 6:
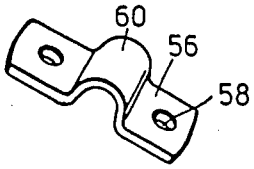
FIG. 6 is a perspective view of a standard connecting strap that is used with the support bracket shown in FIG. 4.

The handrail 10 is preferably constructed from a set of elongate rail members such as the members 36, 38 and 40 shown in FIG. 5. These members can be constructed from a hardwood such as maple and they can be made from round dowel such as $1\frac{1}{2}$ inch dowel. A handrail 10 made from $1\frac{1}{2}$ inch dowel is sufficiently small in diameter that it can be readily grasped by a small child and yet the handrail is sufficiently stiff and strong to provide adequate support. The rail member 38 shown in FIG. 5 has a hole 42 formed in each end. This hole provides means for connecting the rail member 38 to another rail member in end-to-end fashion. Preferably the hole 42 is threaded in order to receive a threaded stud 44 such as the one shown on one end of rail member 40. The member 40 has a hole 42 at the end opposite the end having the stud 44. Three or four of the rail members 40 can form part of the handrail assembly kit together with one of the rail members 38 which would be used at one end of the assembled handrail member 10. The length of members 38 and 40 can vary but typically these pieces would range between 30 and 36 inches in length. Shorter pieces such as the rail 36 shown in FIG. 5 can also be provided as part of a kit in order that the user can construct a handrail member 10 having a length as close as possible to the length of the existing handrail 14. The rail member 36 can be as short as 12 inches in length. If desired a rail member of intermediate length, such as 24 inches, can also be provided.

Figure 7:
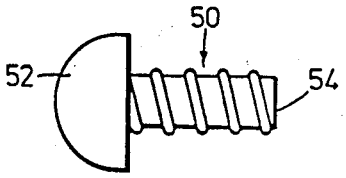
FIG. 7 is a side view of an end cap that can be installed at the end of the handrail member.

FIG. 7 illustrates a wooden end cap member that can be used in conjunction with the rail members shown in FIG. 5. The end cap member 50 has a rounded end portion 52 having a diameter the same as that of the rail members 36, 38 and 40. It also has a threaded portion 54 which is adapted to fit in one of the holes 42. Preferably two end cap members are provided with each kit in order to form the two ends of the handrail member 10. To reduce costs, the end caps could be made inexpensively using a plastics material.

After the hanging devices 26 have been mounted to the wall and the handrail member 10 assembled, small holes can be drilled in one side of the handrail member for attachment of the member to the support brackets 12. A number of connecting straps 56 of standard construction can be used to connect the handrail to the brackets 12. Each strap 56 is provided with two screw holes 58 and a semi-circular loop 60. The loop 60 fits under the end portion 62 of the support bracket 12 and the screws are then used to connect the strap 56 to the bottom of the handrail 10.

It will be understood by those skilled in the art that the metal parts of the present handrail assembly and in particular the hanging devices and the support brackets should be made with rounded corners and completely buffed. Preferably they are coated with a non-toxic plastic paint of a neutral shade. The support brackets 12 can be of standard design for a handrail support. One known type of support bracket that is suitable is that sold by Amerock under model number T-2265-BE.

If desired the round rail members 36, 38 and 40 can be sanded flat on one side to provide a highly suitable region for connection of the support brackets 12. It will be also understood that various means can be used to provide a stiff hanging device 26. For example the device 26 could be provided with ribs along the central region on one side in order to stiffen the device. The use of such ribs would enable a thinner metal plate to be used. Also instead of providing one or more rail members 40 having an integral stud 44, all rail members could be provided with holes 42 at both ends. Suitable threaded connectors could then be provided separately to attach the rail members end-to-end. These threaded connectors could be made from a strong plastic material.

It will be obvious to those skilled in the construction of handrails that various other modifications and changes could be made to the handrail assembly of the present invention without departing from the spirit and scope of the invention. All such modification and changes as fall within the scope of the appended claims are intended to form part of the invention.

What I claim as my invention is:

1. A handrail assembly comprising a handrail member, support brackets connectable to said handrail member at one end for supporting said handrail member at a short uniform distance from an adjacent wall, at least two elongate hanging devices for mounting said handrail member below another handrail, said devices being adapted to be mounted at one end to said adjacent wall at the same location as said other handrail and each connectable at the other end to one of said support brackets, and means for connecting said other end of each hanging device to one of said support brackets.

2. A handrail assembly according to claim 1 wherein said hanging devices are flat at least at the one ends thereof adapted to be mounted to said adjacent wall and have screw or bolt holes formed in said one ends.

3. A handrail assembly according to claim 1 wherein said handrail member is constructed from several elongate members of predetermined length detachably connected together end-to-end.

4. A handrail assembly according to claim 2 wherein each hanging device is constructed from substantially flat metal plate and a slight arc is formed in said hanging device from one end thereof to the other, said arc being in a plane perpendicular to the metal plate.

5. A handrail assembly according to claim 2 wherein the hanging devices are at least 12 inches long.

6. A handrail assembly according to claim 2 including screws for attaching both the hanging devices and said another handrail to said adjacent wall, each of said screws in use extending through a hole in a support bracket for said another handrail and a hole in said one end of a hanging device.

7. A handrail assembly according to claim 2 wherein each hanging device is rigidly connected to one of said support brackets at said other end.

8. A handrail assembly according to claim 2 wherein each hanging device is a substantially flat, elongate metal plate and is permanently and rigidly connected to one of said support brackets at said other end.

9. A handrail assembly according to claim 3 wherein said handrail member is made of wood and constructed from elongate members that are connected together by threaded connecting means at the two ends of each elongate member.

10. A handrail assembly according to claim 9 including two end cap members adapted to fit in holes at opposite ends of the handrail member.

11. A handrail assembly comprising a set of elongate rail members having means for connecting said rail members together in end-to-end fashion to form a handrail member of desired length;

at least two elongate hanging devices for mounting said handrail member below another handrail, each of said devices being capable of being mounted at one end thereof to a wall at a location which is a mounting point for said another handrail;

support brackets connectable to said handrail member for supporting said handrail member on said hanging devices so that said handrail member is disposed a short uniform distance from said wall; and means for mounting each of said support brackets on the other end of a respective one of said hanging devices.

12. A handrail assembly according to claim 11 wherein each support bracket is rigidly connected to said other end of its respective hanging device.

13. A handrail assembly according to claim 11 wherein each support bracket is permanently riveted to said other end of its respective hanging device.

14. A handrail assembly according to claim 11, wherein each hanging device comprises a flat metal plate member having a slight arc extending from one end thereof to the other in a plane perpendicular to the metal plate.

15. A handrail assembly according to claim 12 wherein each hanging device at said one end has holes formed therein to fit the screw hole pattern of two or more different types of handrail support brackets.

16. A handrail assembly according to claim 11 wherein said hanging devices are all at least 12 inches in length.

17. A handrail assembly according to claim 11, including screws for mounting both the hanging devices and support brackets of said another handrail at the same points to said wall.

18. A handrail assembly according to claim 11, including two end cap members adapted to cover holes in the two ends of the assembled handrail member.

19. A handrail assembly according to claim 12 wherein each of said rail members have threaded connecting means at one or both ends thereof to connect the rail member to another rail member.

20. A handrail assembly according to claim 12 wherein each hanging device has a substantially flat upper end with a set of screw holes formed therein.

* * * * *